US008740264B2

(12) United States Patent
Akizuki et al.

(10) Patent No.: US 8,740,264 B2
(45) Date of Patent: Jun. 3, 2014

(54) VEHICLE DOOR LOCK DEVICE

(75) Inventors: Ryujiro Akizuki, Novi, MI (US); Takashi Nishio, Kariya (JP); Nobuko Watanabe, Anjo (JP); Yasuhiko Sono, Hekinan (JP); Kazunori Kojima, Aichi-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/642,409

(22) PCT Filed: Mar. 17, 2011

(86) PCT No.: PCT/JP2011/056379

§ 371 (c)(1),
(2), (4) Date: Oct. 19, 2012

(87) PCT Pub. No.: WO2011/132482

PCT Pub. Date: Oct. 27, 2011

(65) Prior Publication Data

US 2013/0036779 A1 Feb. 14, 2013

(30) Foreign Application Priority Data

Apr. 22, 2010 (JP) ..... 2010-098722

(51) Int. Cl.
*E05C 3/06* (2006.01)
*E05C 3/16* (2006.01)

(52) U.S. Cl.
USPC ..... 292/201; 292/216; 292/DIG. 23; 292/DIG. 65

(58) Field of Classification Search
USPC ..... 292/201, 216, DIG. 23, DIG. 65
See application file for complete search history.

(56) References Cited

U.S. PATENT DOCUMENTS 7,926,857 B2 * 4/2011 Akizuki et al. ..... 292/201
8,256,805 B2 * 9/2012 Ishiguro ..... 292/201

(Continued)

FOREIGN PATENT DOCUMENTS

DE 19729188 A1 * 1/1998
EP 1160403 A1 12/2001

(Continued)

OTHER PUBLICATIONS

International Search Report (PCT/ISA/210) issued on May 31, 2011, by the Japanese Patent Office as the International Searching Authority for International Application No. PCT/JP2011/056379.

(Continued)

*Primary Examiner* — Carlos Lugo
*Assistant Examiner* — Alyson M Merlino
(74) *Attorney, Agent, or Firm* — Buchanan Ingersoll & Rooney PC

(57) ABSTRACT

A vehicle door lock device includes an active lever configured to bring an open link into a locked or unlocked state, and a child safety lock mechanism configured to enable pushing force transfer from an inside open lever to the open link in an unset state. Under a condition where the door is in an opened state, the active lever is situated at an unlocked position, and an intermediate member of the child safety lock mechanism is situated at an unset position, when a door opening operation of an inside door handle and an operation of a child safety protector lever for the intermediate member to move from the unset position to a set position are sequentially performed, a pushing portion of the intermediate member is engaged with an engagement portion of the active lever so that the active lever moves from the unlocked position to a locked position.

5 Claims, 12 Drawing Sheets

(56) References Cited

U.S. PATENT DOCUMENTS

| | | | | |
|---|---|---|---|---|
| 8,276,949 | B2 | 10/2012 | Akizuki et al. | |
| 2004/0189016 | A1* | 9/2004 | Fukunaga et al. | 292/201 |
| 2004/0262927 | A1* | 12/2004 | Fukunaga et al. | 292/216 |
| 2005/0023840 | A1* | 2/2005 | Fukunaga et al. | 292/201 |
| 2006/0186675 | A1* | 8/2006 | Suzumura et al. | 292/216 |
| 2008/0048458 | A1* | 2/2008 | Suzumura et al. | 292/216 |
| 2009/0212577 | A1 | 8/2009 | Fukunaga et al. | |
| 2010/0171321 | A1 | 7/2010 | Akizuki et al. | |
| 2010/0327609 | A1* | 12/2010 | Akizuki et al. | 292/85 |

FOREIGN PATENT DOCUMENTS

| | | | | |
|---|---|---|---|---|
| FR | 2773836 | A1 | | 7/1999 |
| GB | 2332235 | A | * | 6/1999 |
| JP | 2002081247 | A | * | 3/2002 |
| JP | 2003003714 | A | * | 1/2003 |
| JP | 2004-244994 | A | | 9/2004 |
| JP | 2006233456 | A | * | 9/2006 |
| JP | 4321404 | B2 | | 6/2009 |
| JP | 2009-167594 | A | | 7/2009 |

OTHER PUBLICATIONS

Written Opinion (PCT/ISA/237) issued on May 31, 2011, by the Japanese Patent Office as the International Searching Authority for International Application No. PCT/JP2011/056379.

U.S. Appl. No. 13/634,653, filed Sep. 13, 2012 entitled "Child Lock Mechanism", Ryujiro Akisuki et al.

European Search Report dated Jun. 20, 2013 issued in the corresponding European Patent Application No. 11771822.1-1603/2562337.

* cited by examiner

VEHICLE DOOR LOCK DEVICE

TECHNICAL FIELD

The present invention relates to a vehicle door lock device capable of maintaining a door of a vehicle in a closed state relative to a body (vehicle body) and achieving a locked state of the door.

BACKGROUND ART

As one of the vehicle door lock devices, there is a vehicle door lock device including a latch mechanism which is assembled to a door together with a housing, and an inside open lever, an outside open lever, an open link, and an active lever which are assembled to the housing, and this vehicle door lock device is disclosed in, for example, Patent Document 1 below. The latch mechanism is capable of maintaining the door in a closed state relative to a body, and includes a latch engageable with and disengageable from a striker which is assembled to the body, and a lift lever capable of maintaining and releasing the engagement of the latch with the striker. The inside open lever is assembled to the housing, and is rotationally driven along with a door opening operation of an inside door handle which is provided on an inner side of the door. The outside open lever is assembled to the housing, and is rotationally driven along with a door opening operation of an outside door handle which is provided on an outer side of the door.

The open link is assembled tiltably to a coupling portion of the outside open lever, which is shifted along with rotation of the outside open lever, and includes a link portion engageable with an engagement arm portion of the lift lever of the latch mechanism. The open link is pushed from an initial position toward the lift lever when the inside open lever or the outside open lever is rotationally driven from an initial position to an actuation position. The active lever is assembled to the housing, and is switched to a locked position through a lock actuation of an electric actuator to bring the open link into a locked state of being unlinkable to the lift lever, and switched to an unlocked position through an unlock actuation of the electric actuator to bring the open link into an unlocked state of being linkable to the lift lever.

PRIOR ART DOCUMENT

Patent Document

[Patent Document 1] JP 4321404 B

In the vehicle door lock device disclosed in the above-mentioned Patent Document 1, an emergency operation member (operation tab) is assembled integrally to a rotation shaft of the active lever. With the emergency operation member, the active lever can be rotationally driven through a manual operation performed from the inner side of the door in a case of emergency (for example, in a case where an electric motor of the electric actuator is not actuated). Thus, it is possible to deal with the emergency (to manually switch the active lever from the unlocked position to the locked position). Note that, an operation hole is formed in the emergency operation member for fitting therethrough a tool such as a key plate and a screwdriver.

SUMMARY OF THE INVENTION

Technical Problems

By the way, the vehicle door lock device disclosed in the above-mentioned Patent Document 1 can appropriately deal with the emergency (can lock the door) as described above, but the emergency operation member assembled integrally to the rotation shaft of the active lever is exposed to the inner side of the door through the housing so that the emergency operation member is rotatable through a manual operation from the inner side of the door. Therefore, the through hole for exposing the emergency operation member needs to be provided in the housing so as only to deal with the emergency, and a water proofing property between the through hole of the housing and the emergency operation member needs to be taken into consideration. Further, there is a room for improvement in operability of the above-mentioned emergency operation member because the emergency operation member can be rotated only with a tool such as a key plate and a screwdriver.

Solution to Problems

The present invention has been made to solve the above-mentioned problems, and focuses on a child safety lock mechanism built into the inside open lever. The child safety lock mechanism is configured to enable pushing force transfer from the inside open lever to the open link in an unset state, and to disable the pushing force transfer in a set state.

A vehicle door lock device according to the present invention includes: a latch mechanism capable of maintaining a door of a vehicle in a closed state relative to a body, and assembled to the door together with a housing; an inside open lever assembled to the housing, and rotationally driven from an initial position to an actuation position along with a door opening operation of an inside door handle which is provided on an inner side of the door; an outside open lever assembled to the housing, and rotationally driven from an initial position to an actuation position along with a door opening operation of an outside door handle which is provided on an outer side of the door; an open link assembled tiltably to a coupling portion of the outside open lever, which is shifted along with rotation of the outside open lever, the open link including a link portion engageable with an engagement arm portion of a lift lever of the latch mechanism, the open link being pushed from an initial position toward the lift lever when the inside open lever or the outside open lever is rotationally driven from the initial position to the actuation position; an active lever assembled to the housing, the active lever being switched to a locked position through a lock actuation of an electric actuator to bring the open link into a locked state of being unlinkable to the lift lever, and switched to an unlocked position through an unlock actuation of the electric actuator to bring the open link into an unlocked state of being linkable to the lift lever; and a child safety lock mechanism built into the inside open lever, the child safety lock mechanism being configured to enable pushing force transfer from the inside open lever to the open link in an unset state, and to disable the pushing force transfer in a set state.

The inside open lever having the child safety lock mechanism built thereto includes: a first lever assembled to the housing, and linked to the latch mechanism; a second lever assembled to the housing, and operated in association with the inside door handle; an intermediate member interposed between the first lever and the second lever, the intermediate member being retainable at an unset position or a set position; and a child safety protector lever assembled to the housing, the child safety protector lever allowing the intermediate member to move to the unset position or the set position through a manual operation performed from the inner side of the door.

The active lever includes an engagement portion set thereon, and the intermediate member includes a pushing portion set thereon. When the intermediate member is situated at the unset position, the inside door handle is operated to open the door, and the child safety protector lever moves the intermediate member to the set position, the pushing portion of the intermediate member is set to engage with the engagement portion of the active lever so that the active lever is movable to the locked position.

Advantageous Effects of Invention

According to the vehicle door lock device of the present invention, the pushing portion is set on the intermediate member, and the engagement portion is set on the active lever. When the intermediate member is situated at the unset position, the inside door handle is operated to open the door, and the child safety protector lever moves the intermediate member to the set position, the pushing portion of the intermediate member is set to engage with the engagement portion of the active lever so that the active lever is movable to the locked position.

Therefore, in a case of emergency (for example, in a case where the electric motor of the electric actuator is not actuated), under the opened state of the door, a manual operation of operating the inside door handle to open the door and a manual operation of operating the child safety protector lever from the unset position to the set position are sequentially performed so that the active lever situated at the unlocked position can be moved to the locked position. Thus, when the inside door handle is then returned to the return position and the door is closed, a locked state of the door (door-locked state) is obtained.

By the way, according to the vehicle door lock device of the present invention, the inside door handle and the child safety protector lever of the child safety lock mechanism are utilized to move the active lever, which is situated at the unlocked position, to the locked position. In the vehicle door lock device including the child safety lock mechanism, the inside door handle and the child safety protector lever as existing components are used. Therefore, the emergency operation member to be used only when dealing with the emergency is unnecessary, and hence various problems which may be caused by employing the emergency operation member do not arise.

BRIEF DESCRIPTION OF THE DRAWINGS

FIG. 6 is an explanatory view for illustrating an actuation in the state where the outside open lever is actuated in the door opening direction with the configuration illustrated in FIG. 4.

FIG. 10 is an explanatory view for illustrating an actuation in the state where the outside open lever is actuated in the door opening direction with the configuration illustrated in FIG. 8.

MODE FOR CARRYING OUT THE INVENTION

Figure 1:
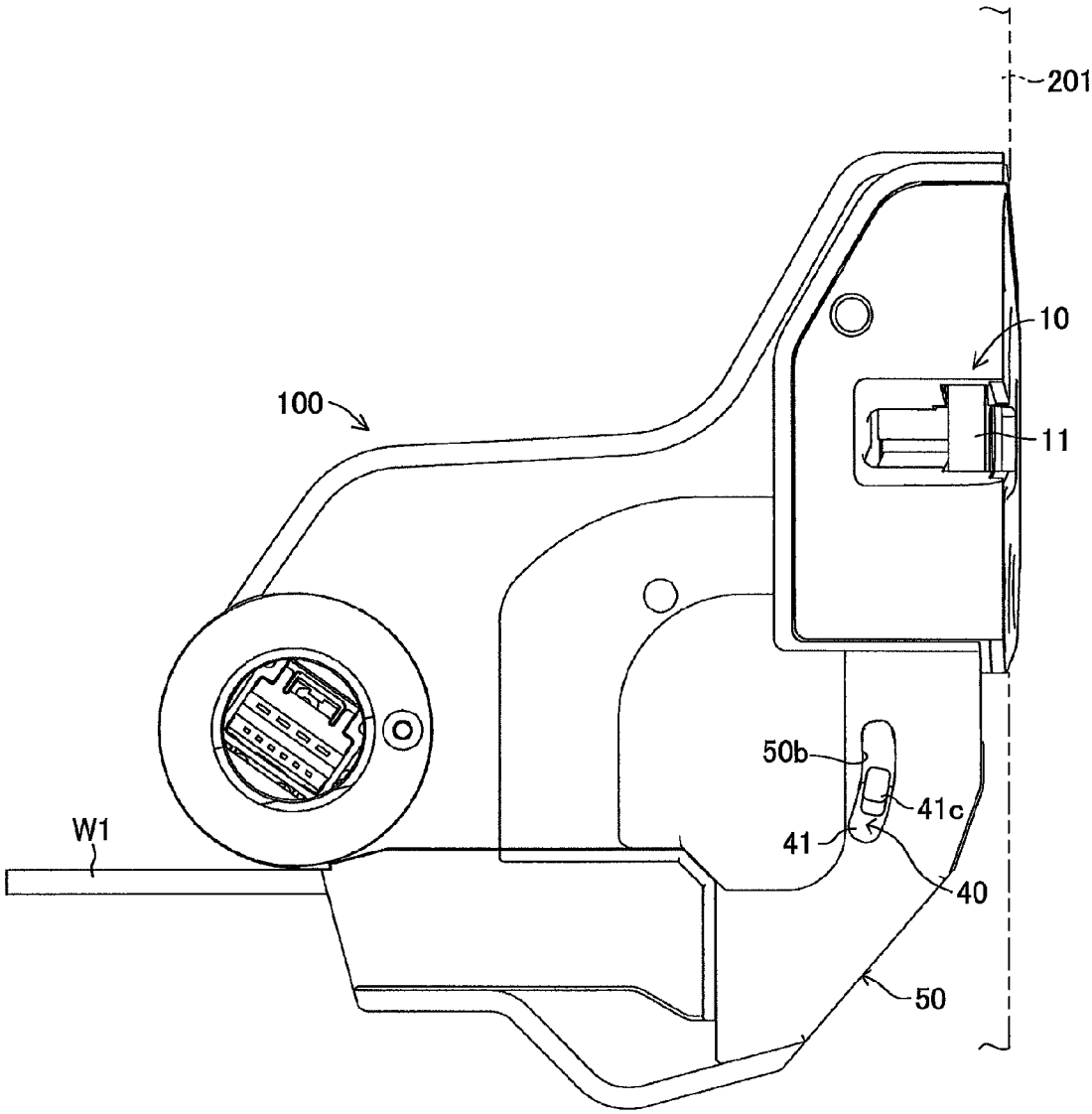
FIG. 1 is a side view of a vehicle door lock device according to an embodiment of the present invention as seen from an inner side of a vehicle.
Figure 2:
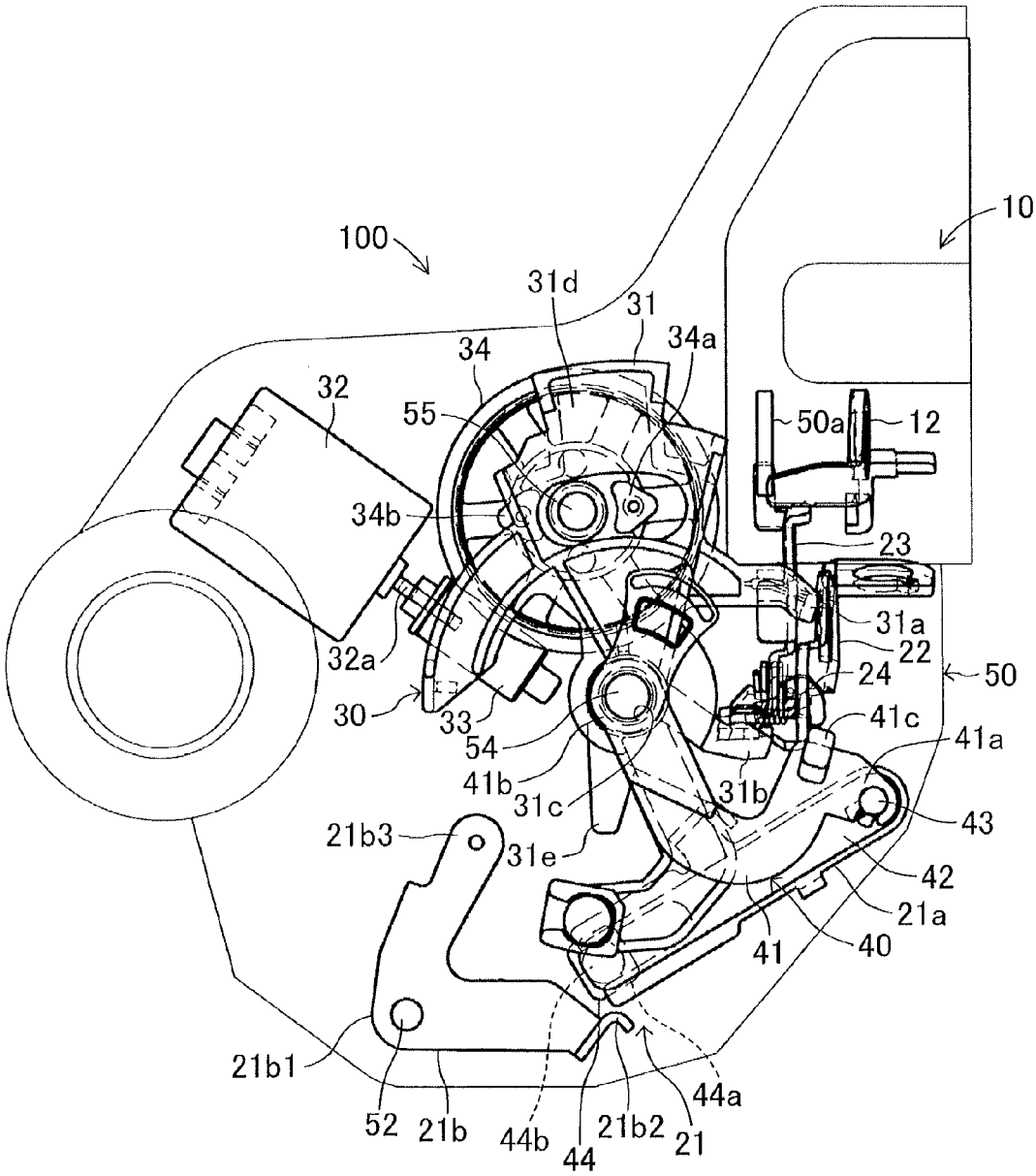
FIG. 2 is a side view for illustrating a relationship among main components of the vehicle door lock device illustrated in FIG. 1.

In the following, an embodiment of the present invention is described with reference to the drawings. FIGS. 1 to 12 illustrate a vehicle door lock device according to the embodiment of the present invention. A vehicle door lock device 100 of this embodiment is mounted to a door 201 which is installed on a rear right side of a vehicle (see FIG. 12). As illustrated in FIGS. 1 and 2, the vehicle door lock device 100 includes a latch mechanism 10, an inside open lever 21, and an outside open lever 22, and further includes an open link 23, a lock operation unit 30, and a child safety lock mechanism 40. Note that, the inside open lever 21, the outside open lever 22, the open link 23, the lock operation unit 30, the child safety lock mechanism 40, and other components are assembled to a housing 50 (as a base member for assembling the components into the door) which is assembled to the door 201 together with the latch mechanism 10.

As is well known, the latch mechanism 10 is configured to maintain the door 201 in a closed state relative to a body 202, and is assembled to the housing 50, that is, assembled to the door 201 together with the housing 50. The latch mechanism 10 includes a latch 11 engageable with and disengageable from a striker 203 which is fixed to the body 201 (see FIGS. 1 and 12), a pawl (not shown) which is engageable with and disengageable from the latch 11 and is capable of maintaining and releasing the engagement of the latch 11 with the striker 203, and a lift lever 12 (see FIG. 4) provided integrally with the pawl (not shown).

Figure 4:
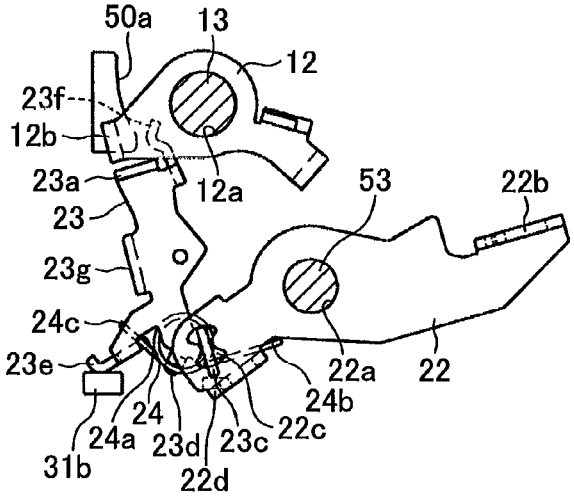
FIG. 4 is a view for illustrating a relationship in a vehicle width direction among an outside open lever, a spring, an open link, the active lever, a lift lever, and an unlocked state maintaining guide provided to a cover of a housing in the state illustrated in FIG. 3.
Figure 5:
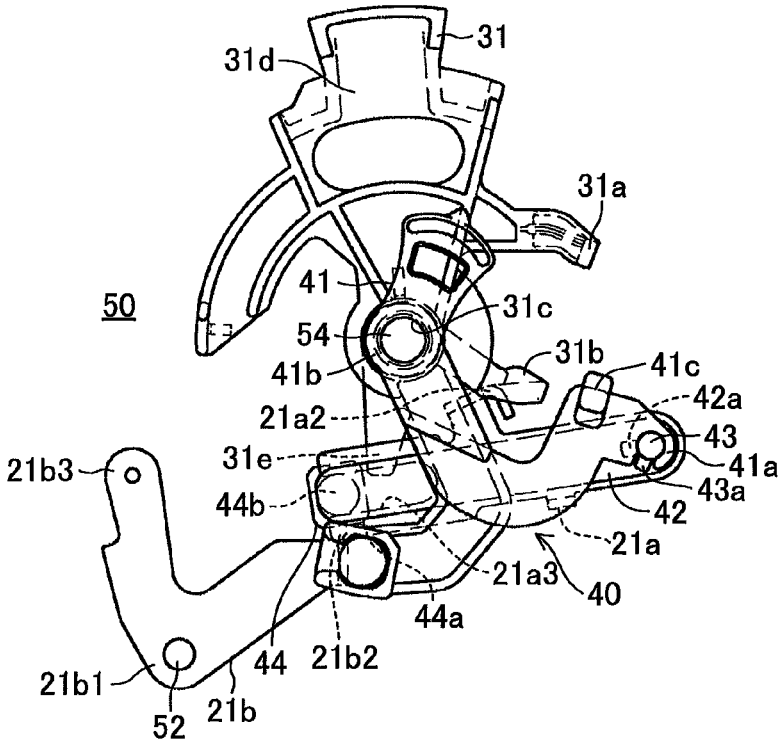
FIG. 5 is an explanatory view for illustrating an actuation at the time when the inside open lever illustrated in FIG. 3 is actuated in a door opening direction.

As illustrated in FIG. 4, the lift lever 12 is assembled integrally to a rotation shaft 13 of the pawl (not shown) through a fitting hole 12*a* thereof, and rotates integrally with the pawl (not shown). The lift lever 12 includes an engagement arm portion 12*b* engageable with and disengageable from a link head portion 23*a* of the open link 23, and a main portion of the lift lever 12 (portion of the lift lever 12 which is fitted to the rotation shaft 13) rotates in a plane substantially parallel to the drawing sheet of FIG. 4.

In the above-mentioned latch mechanism 10, when the latch 11 engages with the striker 203 and their engagement is maintained, the door 201 is maintained in a closed state (latched state). Further, in the latch mechanism 10, when the latch 11 disengages and separates from the striker 203, the door 201 shifts from the closed state to an opened state (unlatched state).

The inside open lever 21 is drivable along with an operation of an inside door handle 204 which is provided on an inner side of the door 201. The inside open lever 21 is assembled rotatably to the housing 50, and includes a first lever 21*a* which is linked to the latch mechanism 10, and a second lever 21*b* which is assembled rotatably to the housing 50 and is operated in association with the inside door handle 204.

Figure 11:
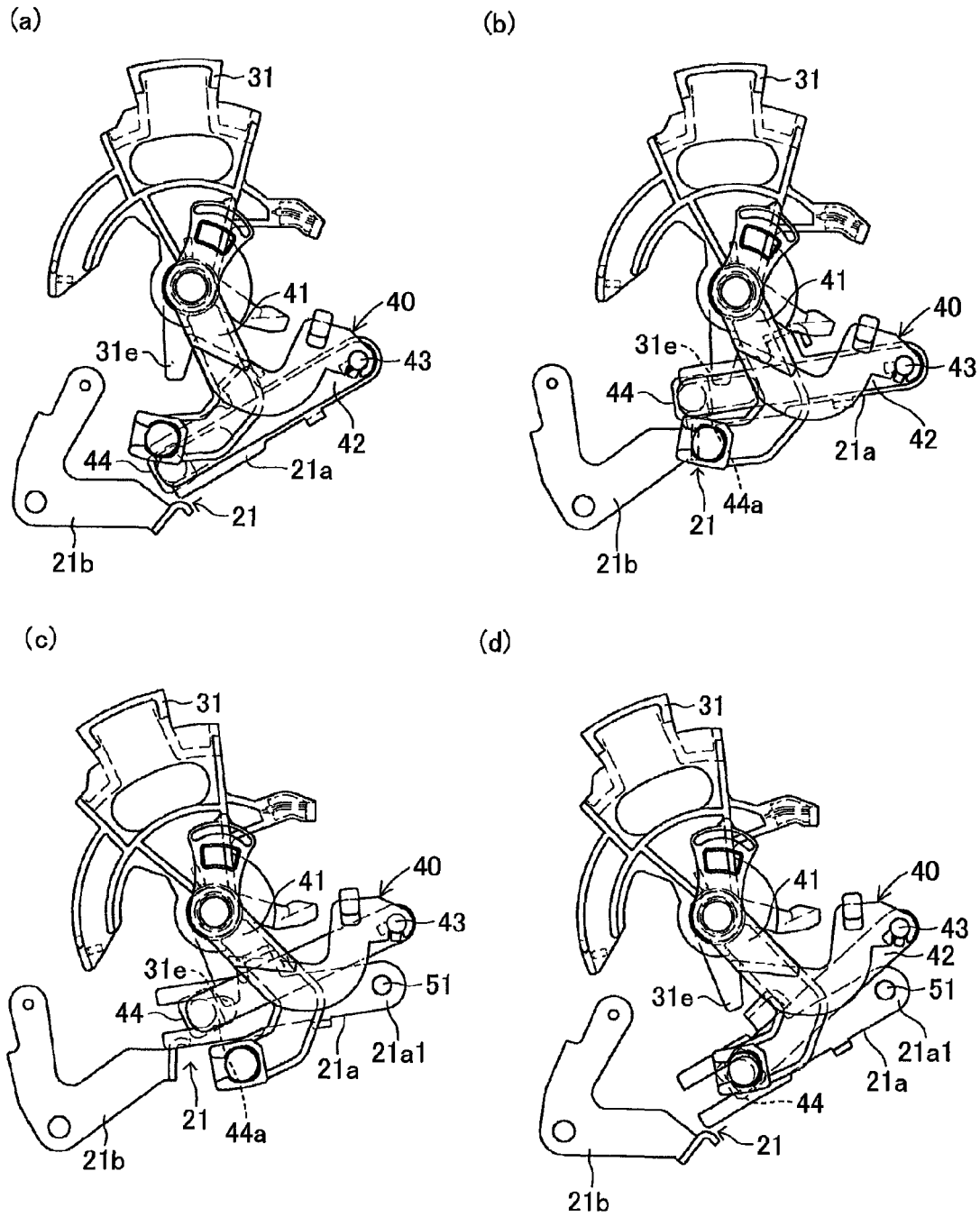
FIG. 11 are explanatory views of actuation, for illustrating steps (procedures) of moving the active lever, which is situated at the unlocked position, to the locked position through use of an inside door handle and a child safety protector lever of the child safety lock mechanism.
Figure 12:
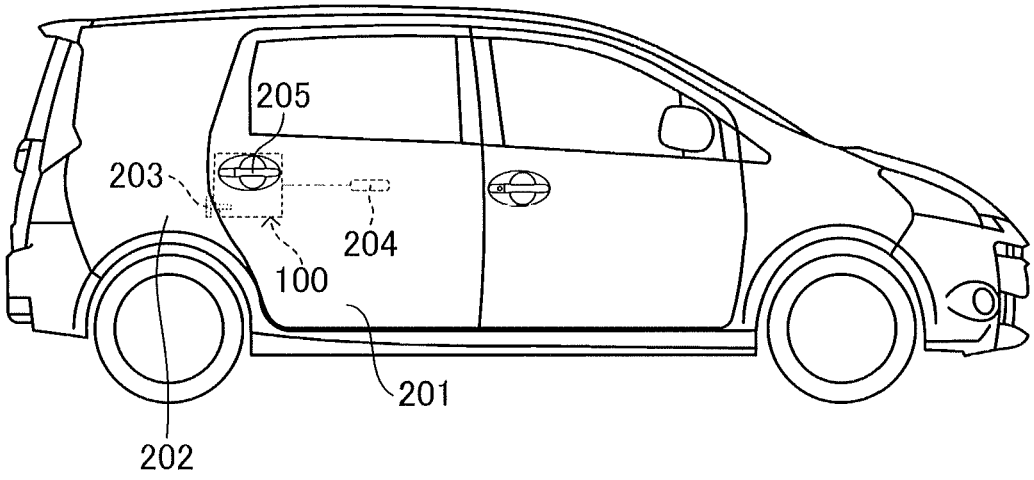
FIG. 12 is a right side view of a vehicle including the vehicle door lock device illustrated in FIGS. 1 to 11.

In the inside open lever 21, when the child safety lock mechanism 40 is held in an unset state (see FIGS. 11(*a*) and 11(*b*)), the rotation of the second lever 21*b* is transferable to the first lever 21*a* so that pushing force transfer from the inside open lever 21 to the open link 23 is enabled. When the child safety lock mechanism 40 is held in a set state (see FIG. 11(*d*)), the rotation of the second lever 21*b* is non-transferable to the first lever 21*a* so that the pushing force transfer from the inside open lever 21 to the open link 23 is disabled.

Figure 3:
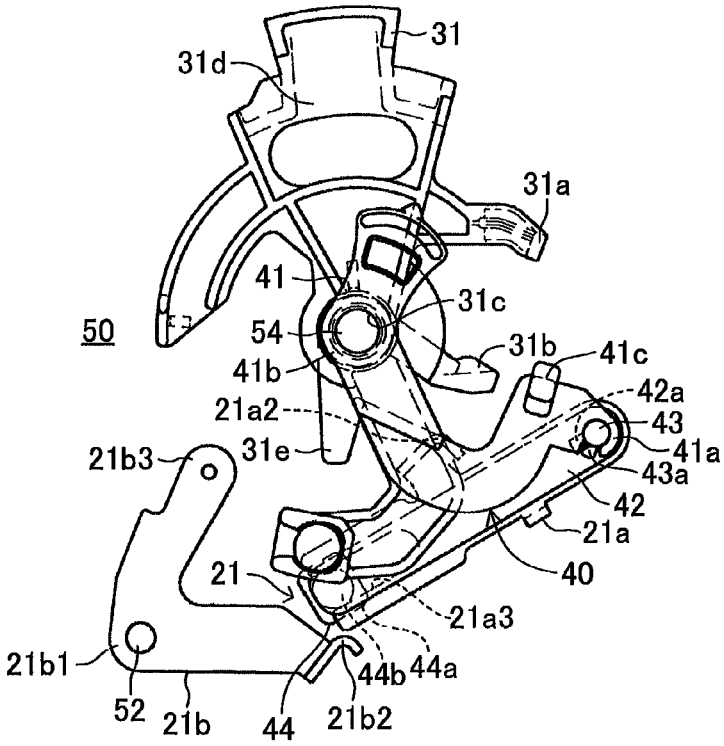
FIG. 3 is a view for illustrating a relationship among an inside open lever, an active lever, and a child safety lock mechanism at the time when the active lever illustrated in FIG. 2 is situated at an unlocked position and the child safety lock mechanism is held in an unset state.

As illustrated in FIGS. 11(*c*) and 11(*d*), the first lever 21*a* is assembled rotatably to the housing 50 through an intermediation of a support shaft 51 at one end portion 21*a*1. As illustrated in FIGS. 3 and 4, the first lever 21*a* includes, at a middle portion thereof, a pushing portion 21*a*2 engageable with an inside engagement portion 22*d* of the outside open lever 22, and further includes a linear engagement groove 21*a*3 at another end portion (rotation distal end portion) thereof. The first lever 21*a* is linked to the lift lever 12 of the latch mechanism 10 through an intermediation of the outside open lever 22 and the open link 23 (see FIG. 4) at the pushing portion 21*a*2, and when the lock operation unit 30 is held in an unlocked state of FIG. 2, the first lever 21*a* is rotationally driven from an initial position of FIG. 3 to an actuation position of FIG. 5 so that the first lever 21*a* can push the open link 23 from an initial position of FIG. 4 toward the lift lever 12.

As illustrated in FIGS. 2 and 3, the second lever 21*b* is assembled rotatably to the housing 50 through an intermediation of a support shaft 52 at a base end portion 21*b*1. The second lever 21*b* includes, at one end portion thereof, an engagement portion 21*b*2 engageable with a rectangular bush 44*a* of an intermediate member 44 of the child safety lock mechanism 40, and further includes, at another end portion thereof, an operation arm portion 21*b*3 coupled through an intermediation of a coupling member (see an operation cable W1 of FIG. 1) to the inside door handle 204 which is provided on an inner side of the door 201. When the inside door handle 204 is operated to open the door, the second lever 21*b* is rotationally driven from an initial position of FIGS. 2 and 3 to an actuation position of FIG. 5.

The outside open lever 22 is rotationally drivable from an initial position (return position of FIGS. 4 and 8) to an actuation position (position of FIGS. 6 and 10) along with a door opening operation of an outside door handle 205 which is provided on an outer side of the door 201, and is assembled rotatably to the housing 50 through an intermediation of a support shaft 53 (arranged substantially orthogonal to the above-mentioned support shafts 51 and 52) at a support hole 22*a*. The outside open lever 22 includes an operation portion 22*b* linked to the outside door handle 205 through an intermediation of an operation force transferring member (not shown) such as a link, a coupling hole portion (coupling portion) 22*c* coupled to the open link 23, and the engagement arm portion 22*d* engageable with and disengageable from the pushing portion 21*a*2 of the first lever 21*a* of the inside open lever 21.

The open link 23 includes the above-mentioned link head portion 23*a* and further includes a coupling leg portion 23*c* and a support portion 23*d* (see FIG. 4). The open link 23 is assembled to the coupling hole portion (coupling portion) 22*c* of the outside open lever 22 at the coupling leg portion 23*c* so as to be tiltable by a predetermined amount in a lateral direction of FIG. 4, and supports a spring 24 at the support portion 23*d*. A main portion of the open link 23 is tilted in a plane substantially parallel to the drawing sheet of FIG. 4, and this plane is arranged in parallel to the plane in which the main portion of the lift lever 12 rotates. Further, the open link 23 includes an engagement leg portion 23*e* engageable with and disengageable from a push arm portion 31*b* of an active lever 31 of the lock operation unit 30, an engagement arm portion 23*f* engageable with and disengageable from an unlocked state maintaining guide 50*a*, and an engagement body portion 23*g* engageable with and disengageable from a locked state maintaining guide 31*a* (see FIGS. 8 and 10).

Figure 6:
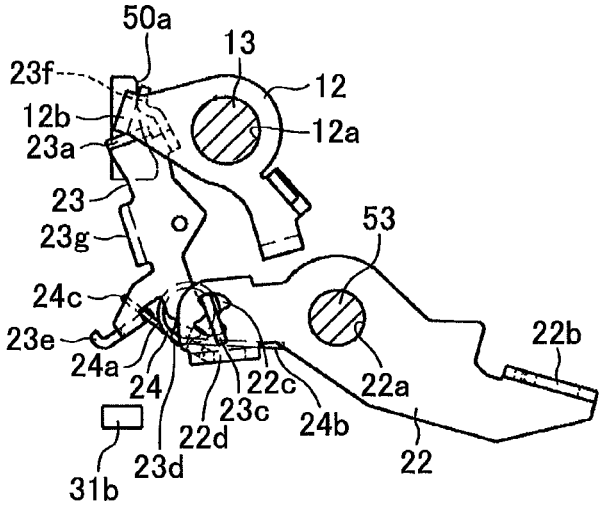
FIG. 6 is a view for illustrating a relationship in the vehicle width direction among the outside open lever, the spring, the open link, the active lever, the lift lever, and the unlocked state maintaining guide provided to the cover of the housing in the state illustrated in FIG. 5. Specifically.
Figure 7:
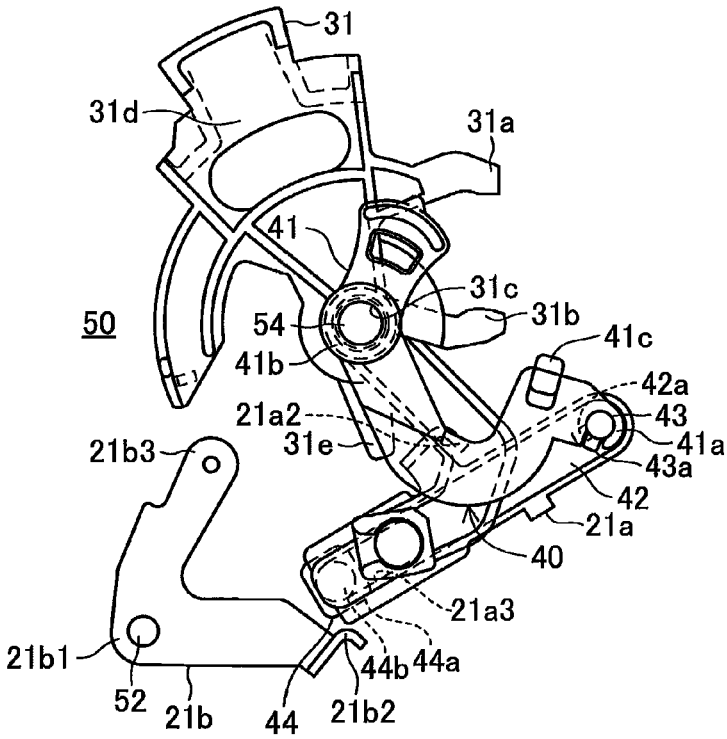
FIG. 7 is a view for illustrating a relationship among the inside open lever, the active lever, and the child safety lock mechanism at the time when the active lever illustrated in FIG. 2 is situated at a locked position and the child safety lock mechanism is held in the unset state.
Figure 8:
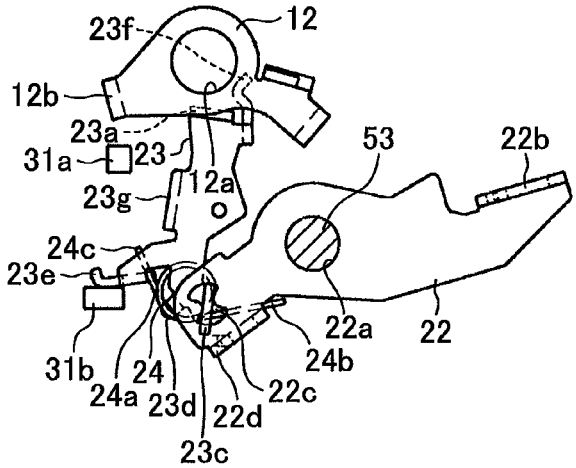
FIG. 8 is a view for illustrating a relationship in the vehicle width direction among the outside open lever, the spring, the open link, the active lever, the lift lever, and a locked state maintaining guide provided to the active lever in the state illustrated in FIG. 7.
Figure 9:
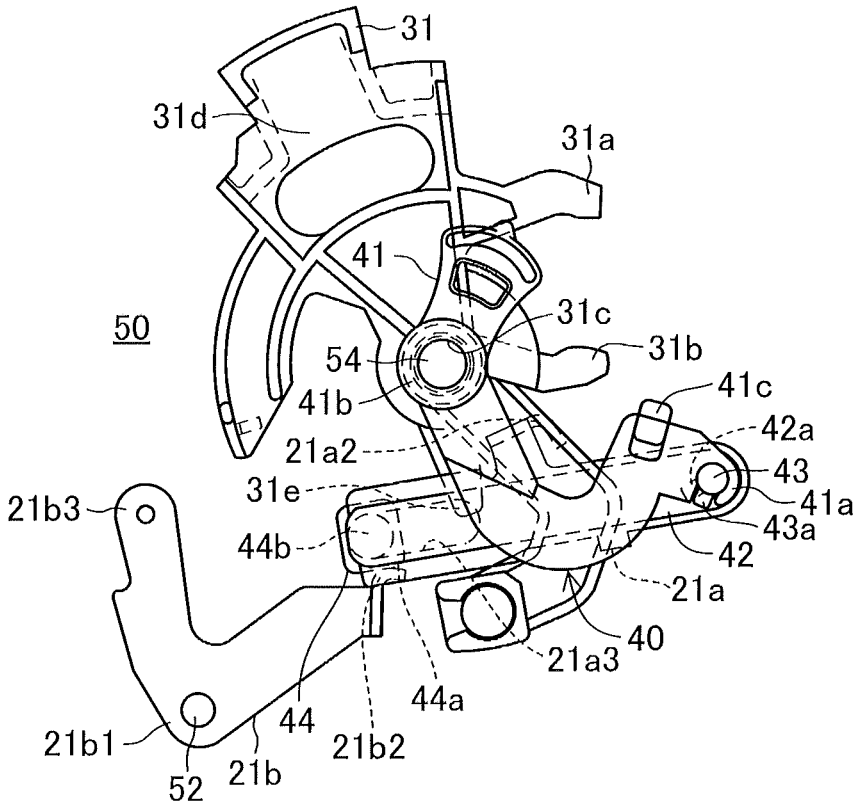
FIG. 9 is an explanatory view for illustrating an actuation at the time when the inside open lever illustrated in FIG. 7 is actuated in the door opening direction.
Figure 10:
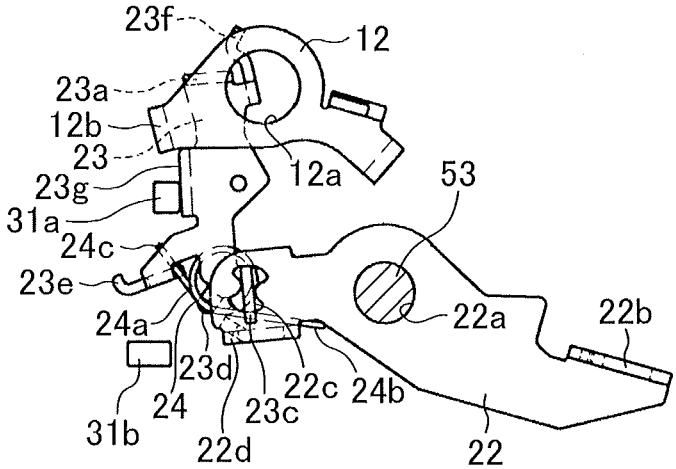
FIG. 10 is a view for illustrating a relationship in the vehicle width direction among the outside open lever, the spring, the open link, the active lever, the lift lever, and the locked state maintaining guide provided to the active lever in the state illustrated in FIG. 9. Specifically.

When the first lever 21*a* of the inside open lever 21 is rotationally driven from the initial position to the actuation position or when the outside open lever 22 is rotationally driven from the initial position to the actuation position, the open link 23 is pushed from the initial position of FIG. 4 or 8 toward the lift lever 12, and is moved to an actuation position of FIG. 6 or 10. Further, when the active lever 31 moves from a locked position (position of FIGS. 7 and 9) to an unlocked position (position of FIGS. 2 and 3), the open link 23 is switchable to an unlocked state (state of FIG. 4), and when the active lever 31 moves from the unlocked position to the locked position, the open link 23 is switchable to a locked state (state of FIG. 8).

Note that, when the open link 23 is held in the unlocked state, as illustrated in FIGS. 4 and 6, door opening actuations of the open levers 21 and 22 along with the door opening operations of the door handles 204 and 205 are transferred to the lift lever 12 via the open link 23, respectively. On the other hand, when the open link 23 is held in the locked state, as illustrated in FIGS. 8 and 10, the door opening actuations of the open levers 21 and 22 along with the door opening operations of the door handles 204 and 205 are transferred to the open link 23, but are not transferred from the open link 23 to the lift lever 12.

The spring 24 is interposed between the outside open lever 22 and the open link 23, and biases the open link 23 relative to the outside open lever 22 so that the open link 23 is brought into the unlocked state (state of FIG. 4). Further, the spring 24 includes a coil portion 24*a* assembled to the support portion 23*d* of the open link 23, and a pair of arm portions 24*b* and 24*c* extending radially outward from end portions of the coil portion 24*a*. The arm portion 24*b* on one side engages with the outside open lever 22, and the arm portion 24*c* on the other side engages with the open link 23.

Therefore, in a panic state where each of the door handles 204 and 205 and a remote control device (not shown) for actuating an electric motor 32 of the lock operation unit 30 are operated at the same time in a door-locked state (locked state of the door 201), due to the function of the spring 24, the open link 23 is biased so as to be brought into the unlocked state, and is linked to the engagement arm portion 12*b* of the lift lever 12 so as to be elastically and relatively movable. In addition, the open link 23 is reliably returned to the initial position of FIG. 4.

The lock operation unit 30 is configured to switch the open link 23 to an unlocked position or a locked position. The lock operation unit 30 includes the active lever 31 which is rotationally drivable and is switchable between the unlocked position and the locked position, and further includes the electric motor 32, a worm 33, a worm wheel 34, and the like (electric actuator) for rotationally driving the active lever 31 to the locked position or the unlocked position. Through a lock operation of the remote control device (not shown) for actuating the electric motor 32, the active lever 31 is switched from the unlocked position of FIGS. 2 and 3 to the locked position of FIG. 7 to bring the open link 23 into the locked state. Further, through an unlock operation of the remote control device (not shown) for actuating the electric motor 32, the active lever 31 is switched from the locked position to the unlocked position to bring the open link 23 into the unlocked state. The active lever 31 is assembled rotatably to the housing 50 through an intermediation of a support shaft 54 at a support hole 31*c* provided in a boss portion.

The active lever 31 includes the above-mentioned locked state maintaining guide 31*a*, push arm portion 31*b*, and support hole 31*c*, and further includes a drive portion 31*d* linked to a pair of cams 34*a* and 34*b* provided on the worm wheel 34. Note that, the active lever 31 is retainable at the unlocked position or the locked position by a positioning spring (not shown) which is assembled into the housing 50 and is engageable with an engagement pin portion (not shown) provided on the active lever 31.

The electric motor 32 is a publicly known motor to be driven in accordance with the lock operation and the unlock operation of the remote control device or the like. The worm 33 is provided integrally to an output shaft 32*a* of the electric motor 32, and is rotationally driven by the electric motor 32. The worm wheel 34 is rotationally drivable by the worm 33, and is assembled rotatably to the housing 50 through an intermediation of a support shaft 55. The worm wheel 34 includes the pair of cams 34*a* and 34*b* linked to a pair of cam followers provided on the drive portion 31*d* of the active lever 31 (indicated by the broken lines in FIGS. 2, 3, and the like, though detailed description thereof is omitted herein).

In the above-mentioned lock operation unit 30, when the active lever 31 is situated at the unlocked position of FIGS. 2 and 3 and the remote control device (not shown) for actuating the electric motor 32 is operated to lock the door, the electric motor 32 rotationally drives the worm wheel 34 via the worm 33 in a counterclockwise direction by 180 degrees so that the active lever 31 moves to the locked position of FIG. 7. When the active lever 31 is situated at the locked position of FIG. 7 and the remote control device (not shown) for actuating the electric motor 32 is operated to unlock the door, the electric motor 32 rotationally drives the worm wheel 34 via the worm 33 in a clockwise direction by 180 degrees so that the active lever 31 moves to the unlocked position of FIGS. 2 and 3.

The child safety lock mechanism 40 is built into the inside open lever 21, and is configured to enable the pushing force transfer from the inside open lever 21 to the outside open lever 22 and the open link 23 in the unset state (state of, for example, FIGS. 11(*a*) and 11(*b*)), and to disable the pushing force transfer in the set state (state of, for example, FIG. 11(*d*)). The child safety lock mechanism 40 includes a child safety protector lever 41 and further includes a coupling link 42, a support pin 43, and the intermediate member 44.

The intermediate member 44 includes the rectangular bush 44*a* and a coupling shaft 44*b*, and is assembled to the first lever 21*a* but is not assembled to the second lever 21*b*. Further, the intermediate member 44 is coupled to one end portion 41*a* of the child safety protector lever 41 through an intermediation of the coupling link 42 and the support pin 43. The coupling link 42 is rotatable about the support pin 43, and hence the intermediate member 44 is rotatable relative to the housing 50. The coupling shaft 44*b* is coupled integrally to the rectangular bush 44*a* at one end thereof, and is coupled integrally to the coupling link 42 at the other end thereof. Further, on an outer periphery (circular part) of a middle portion of the coupling shaft 44*b*, the coupling shaft 44*b* is assembled slidably to the linear engagement groove 21*a*3 which is provided to the first lever 21*a*.

When the child safety protector lever 41 is retained at an unset position of, for example, FIG. 11(*a*), the intermediate member 44 is retainable at an unset position of FIG. 11(*a*). When the child safety protector lever 41 is retained at a set position of, for example, FIG. 11(*d*), the intermediate member 44 is retainable at a set position of FIG. 11(*d*). Thus, the intermediate member 44 is movable to the unset position or the set position by the child safety protector lever 41.

The child safety protector lever 41 is assembled rotatably to the housing 50 through an intermediation of the support shaft 54 at a middle portion 41*b*, and is retainable at the unset position of FIGS. 11(*a*) and 11(*b*) or the set position of FIGS. 11(*c*) and 11(*d*). Further, the child safety protector lever 41 includes an operation portion 41*c* provided in the vicinity of the one end portion 41*a* so as to project outside the housing 50 through an arc-like insertion hole 50*b* of the housing 50 (see FIG. 1). Only under the opened state of the door 201, the child safety protector lever 41 is manually operable by the operation portion 41*c* from a vehicle interior side of the door 201.

The coupling link 42 is coupled to the coupling shaft 44*b* of the intermediate member 44 at one end portion (rotation distal end portion) thereof, and is coupled rotatably to the one end portion 41*a* of the child safety protector lever 41 through an intermediation of the support pin 43 at the other end portion (rotation center portion) thereof. The support pin 43 is assembled non-rotatably to the one end portion 41*a* of the child safety protector lever 41, and rotatably supports the coupling link 42. Further, a protrusion 43*a* is provided integrally to the support pin 43, and a protrusion 42*a* provided to the coupling link 42 engages with the protrusion 43*a* so as to restrict rotation of the coupling link 42 relative to the support pin 43 in a counterclockwise direction of FIG. 3.

In this embodiment, when the active lever 31 is situated at the unlocked position and the outside open lever 22 rotates between the initial position and the actuation position as illustrated in FIGS. 2, 4, and 6, the unlocked state maintaining guide 50*a* provided on the housing 50 maintains the open link 23, which is separated from the push arm portion 31*b* of the active lever 31, in the unlocked state. When the unlocked state maintaining guide 50*a* maintains the open link 23 in the unlocked state, as illustrated in FIG. 6, the engagement arm portion 23*f* of the open link 23 engages slidably with the unlocked state maintaining guide 50*a*. Note that, a guide surface of the unlocked state maintaining guide 50*a* (surface with which the engagement arm portion 23*f* slidably engages) is desired to be shaped in consideration of a movement locus of an engagement portion between the engagement arm portion 12*b* of the lift lever 12 and the link head portion 23*a* of the open link 23 so that a slip does not occur in the above-mentioned engagement portion.

On the other hand, when the active lever 31 is situated at the locked position and the outside open lever 22 rotates between the initial position and the actuation position as illustrated in FIGS. 7 to 10, the locked state maintaining guide 31*a* provided on the active lever 31 maintains the open link 23, which is separated from the push arm portion 31*b* of the active lever 31, in the locked state. When the locked state maintaining guide 31*a* maintains the open link 23 in the locked state, as illustrated in FIG. 10, the engagement body portion 23*g* of the open link 23 engages slidably with the locked state maintaining guide 31*a*.

By the way, in the above-mentioned vehicle door lock device 100, an engagement leg portion 31*e* is set on the active lever 31, and a pushing portion (the rectangular bush 44*a* serves also as this pushing portion) engageable with the engagement leg portion 31*e* is set on the intermediate member 44. When the intermediate member 44 is situated at the unset position, the inside door handle 204 is operated to open the door, and the child safety protector lever 41 moves the intermediate member 44 to the set position, the rectangular bush 44*a* (pushing portion) of the intermediate member 44 is set to engage with the engagement leg portion 31*e* of the active lever 31 so that the active lever 31 is movable from the unlocked position to the locked position (see FIG. 11).

In the vehicle door lock device 100 of this embodiment configured as described above, under a state in which the active lever 31 is situated at the unlocked position and the child safety protector lever 41 is situated at the unset position as illustrated in FIG. 3 (unlocked and unset state), when the inside door handle 204 or the outside door handle 205 is operated to open the door, the inside open lever 21 or the outside open lever 22 is actuated to open the door, and as illustrated in FIG. 4, the open link 23 held in the unlocked state is moved by the outside open lever 22 from the initial position (position of FIG. 4) to the actuation position of FIG. 6 so that the lift lever 12 rotates in an unlatching direction (in a clockwise direction of FIGS. 4 and 6). Therefore, the door opening actuation of the inside open lever 21 or the door opening actuation of the outside open lever 22 is transferred to the lift lever 12 via the open link 23 so that the lift lever 12 rotates in the unlatching direction. As a result, the latch mechanism 10 is switched from the latched state to the unlatched state, and thus the door can be opened.

On the other hand, under a state in which the active lever 31 is situated at the locked position and the child safety protector lever 41 is situated at the unset position as illustrated in FIG. 7 (locked and unset state), when the inside door handle 204 or the outside door handle 205 is operated to open the door, the inside open lever 21 or the outside open lever 22 is actuated to open the door, and as illustrated in FIG. 8, the open link 23 held in the locked state is moved by the outside open lever 22 from the initial position (position of FIG. 8) to the actuation position of FIG. 10. At this time, the open link 23 held in the locked state of FIGS. 8 and 10 is lifted while being guided by the locked state maintaining guide 31*a* provided on the active lever 31, and hence does not engage with the lift lever 12. Therefore, the door opening actuation of the outside open lever 22 is not transferred to the lift lever 12 so that the lift lever 12 does not rotate. As a result, the latch mechanism 10 is maintained in the latched state, and thus the door cannot be opened.

Further, in the vehicle door lock device 100 of this embodiment, under a state in which the active lever 31 is situated at the unlocked position and the child safety protector lever 41 is situated at the set position (unlocked and set state), when the inside door handle 204 is operated to open the door, the first lever 21*a* of the inside open lever 21 idly rotates relative to the intermediate member 44. Therefore, at this time, the outside open lever 22 is not actuated to open the door, and thus the door 201 cannot be opened. Note that, under the above-mentioned unlocked and set state, when the outside door handle 205 is operated to open the door, the outside open lever 22 is actuated to open the door, and thus the door 201 can be opened.

Further, in the vehicle door lock device 100 of this embodiment, under the above-mentioned unlocked and unset state (state of FIG. 11(*a*)) and under the opened state of the door 201, when the inside door handle 204 is operated to open the door, the first lever 21*a* and the second lever 21*b* of the inside open lever 21 rotate as illustrated in FIG. 11(*b*). Therefore, under this state, when the child safety protector lever 41 is operated from the unset position to the set position, the rectangular bush 44*a* (pushing portion) of the intermediate member 44 engages with the engagement leg portion 31*e* of the active lever 31 to push the engagement leg portion 31*e*. Accordingly, as illustrated in FIG. 11(*c*), the active lever 31 moves from the unlocked position to the locked position.

Therefore, in a case of emergency (for example, in a case where the electric motor 32 is not actuated), under the opened state of the door 201, a manual operation of operating the inside door handle 204 to open the door and a manual operation of operating the child safety protector lever 41 from the unset position to the set position are sequentially performed so that the active lever 31 situated at the unlocked position can be moved to the locked position. Thus, when the inside door handle 204 is then returned to the return position and the door 201 is closed, a locked and set state of FIG. 11(*d*) is obtained, and the locked state of the door 201 (door-locked state in which the door 201 cannot be opened even when the inside door handle 204 or the outside door handle 205 is operated to open the door) is obtained. Note that, the above-mentioned locked state of door 201 can be released when the electric motor 32 is repaired to be actuated and then the electric motor 32 is actuated to unlock the door.

By the way, in the vehicle door lock device 100 of this embodiment, the inside door handle 204 and the child safety protector lever 41 of the child safety lock mechanism 40 are utilized to move the active lever 31, which is situated at the unlocked position, to the locked position. In the vehicle door lock device including the child safety lock mechanism 40, the inside door handle 204 and the child safety protector lever 41 as existing components are used. Therefore, the emergency operation member to be used only when dealing with the emergency is unnecessary, and hence various problems which may be caused by employing the emergency operation member do not arise.

In the above-mentioned embodiment (embodiment illustrated in FIGS. 1 to 12), the present invention is carried out in the following manner. That is, the first lever 21*a* of the inside open lever 21 is assembled rotatably to the housing 50, and the intermediate member 44 is assembled to the rotation distal end portion (engagement groove 21*a*3) of the first lever 21*a* so as to be movable linearly, and is coupled to the rotation distal end portion (41*a*) of the child safety protector lever 41 through an intermediation of the coupling link 42 and the support pin 43. Alternatively, as in another embodiment illustrated in FIGS. 13 to 15, the present invention may be carried out in such a manner that a first lever 121*a* is assembled rotatably to the rotation distal end portion (41*a*) of the child safety protector lever 41 through an intermediation of the support pin 43 at one end portion 121*a*1 of the first lever 121*a*, and the intermediate member 44 is assembled integrally to a rotation distal end portion 121*a*3 of the first lever 121*a*. Note that, the first lever 121*a* includes a pushing portion 121*a*2 corresponding to the pushing portion 21*a*2 of the above-mentioned embodiment, and further includes a protrusion (corresponding to the protrusion 42*a* of the above-mentioned embodiment) engageable with and disengageable from the protrusion (43*a*) of the support pin 43.

Figure 13:
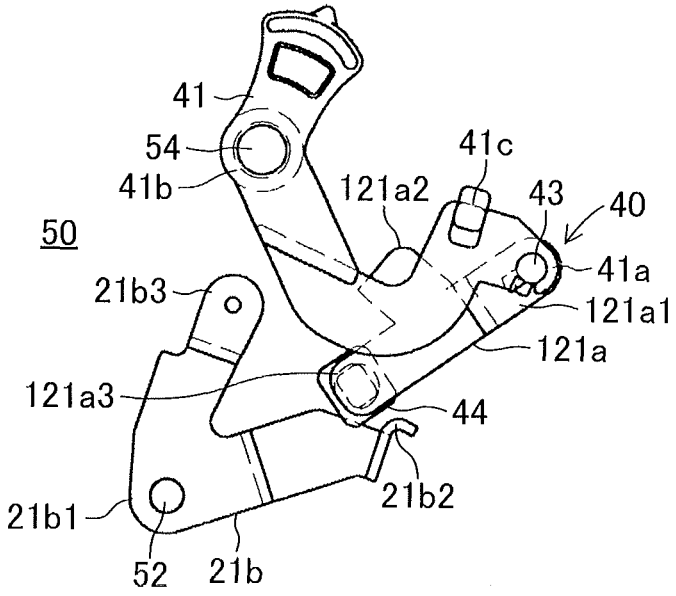
FIG. 13 is a side view corresponding to FIG. 3 (unset state), for illustrating another child safety lock mechanism, which is employable in place of the child safety lock mechanism illustrated in FIG. 3 and other figures.
Figure 14:
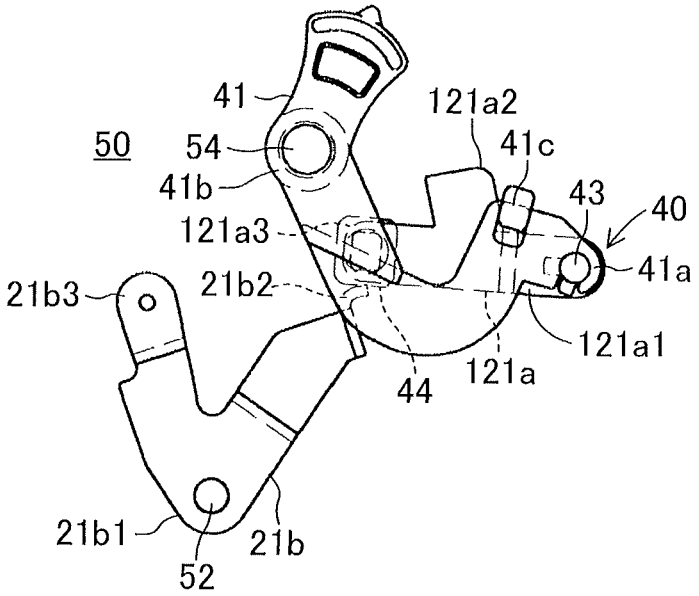
FIG. 14 is an explanatory view for illustrating an actuation at the time when an inside open lever illustrated in FIG. 13 is actuated in the door opening direction.
Figure 15:
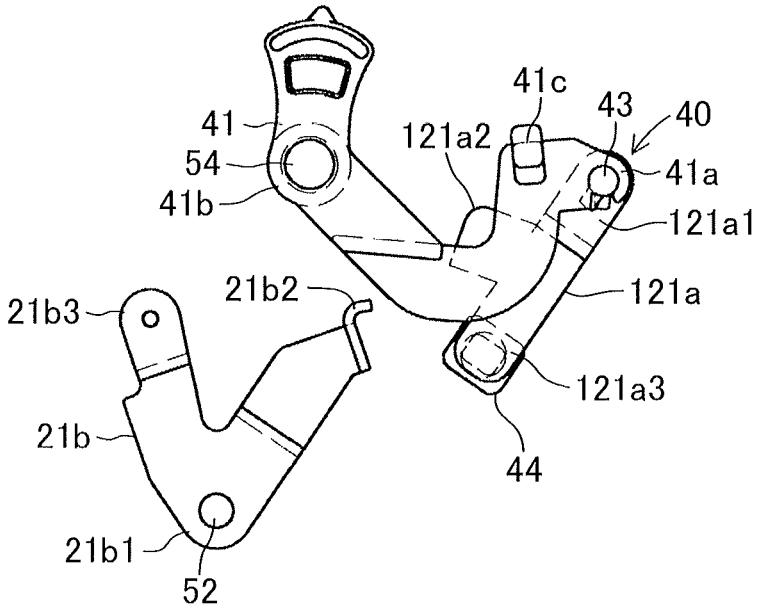
FIG. 15 is an explanatory view for illustrating an actuation at the time when a child safety protector lever illustrated in FIG. 14 is moved to a set position.

In the embodiment illustrated in FIGS. 13 to 15, it is unnecessary to employ the components corresponding to the coupling link 42 and the support shaft 51 which are employed in the embodiment illustrated in FIGS. 1 to 12. Accordingly, the number of components of the child safety lock mechanism 40 can be reduced, and the first lever 121*a* does not need to include the engagement groove (21*a*3), with the result that the child safety lock mechanism 40 can be constructed simply at low cost.

Further, in the above-mentioned embodiment (embodiment illustrated in FIGS. 1 to 12), the present invention is carried out in the following manner. That is, the first lever 21*a* and the second lever 21*b* of the inside open lever 21 are assembled rotatably to the housing 50 through an intermediation of the different support shafts 51 and 52. Alternatively, as in an embodiment illustrated in FIGS. 16 to 18, the present invention may be carried out in such a manner that a first lever 221*a* and a second lever 221*b* of an inside open lever 221 are arranged coaxially with each other, and are assembled rotatably to the housing through an intermediation of a single support shaft 251.

Figure 16:
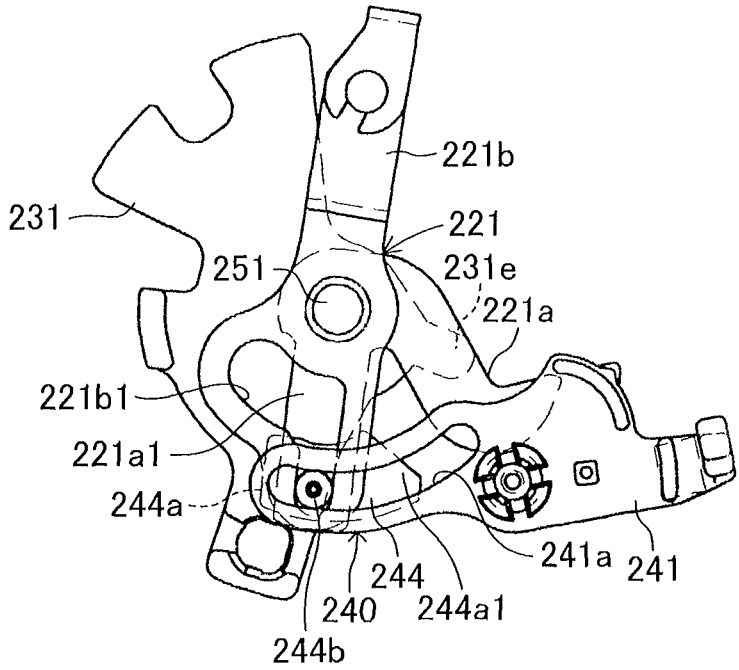
FIG. 16 is a side view corresponding to FIG. 3 (unlocked and unset state), for illustrating an inside open lever, an active lever, and a child safety lock mechanism according to another embodiment of the present invention, which are employable in place of the inside open lever, the active lever, and the child safety lock mechanism illustrated in FIG. 3.
Figure 17:
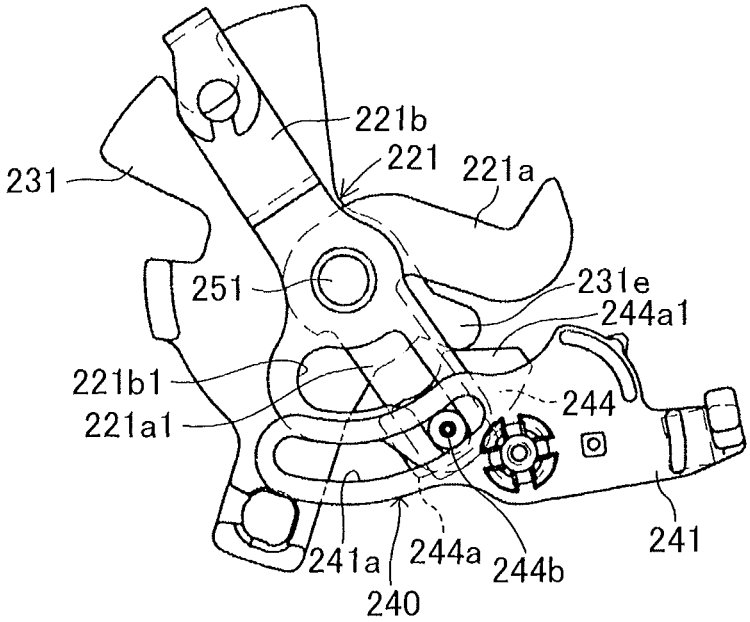
FIG. 17 is an explanatory view for illustrating an actuation at the time when the inside open lever illustrated in FIG. 16 is actuated in the door opening direction.
Figure 18:
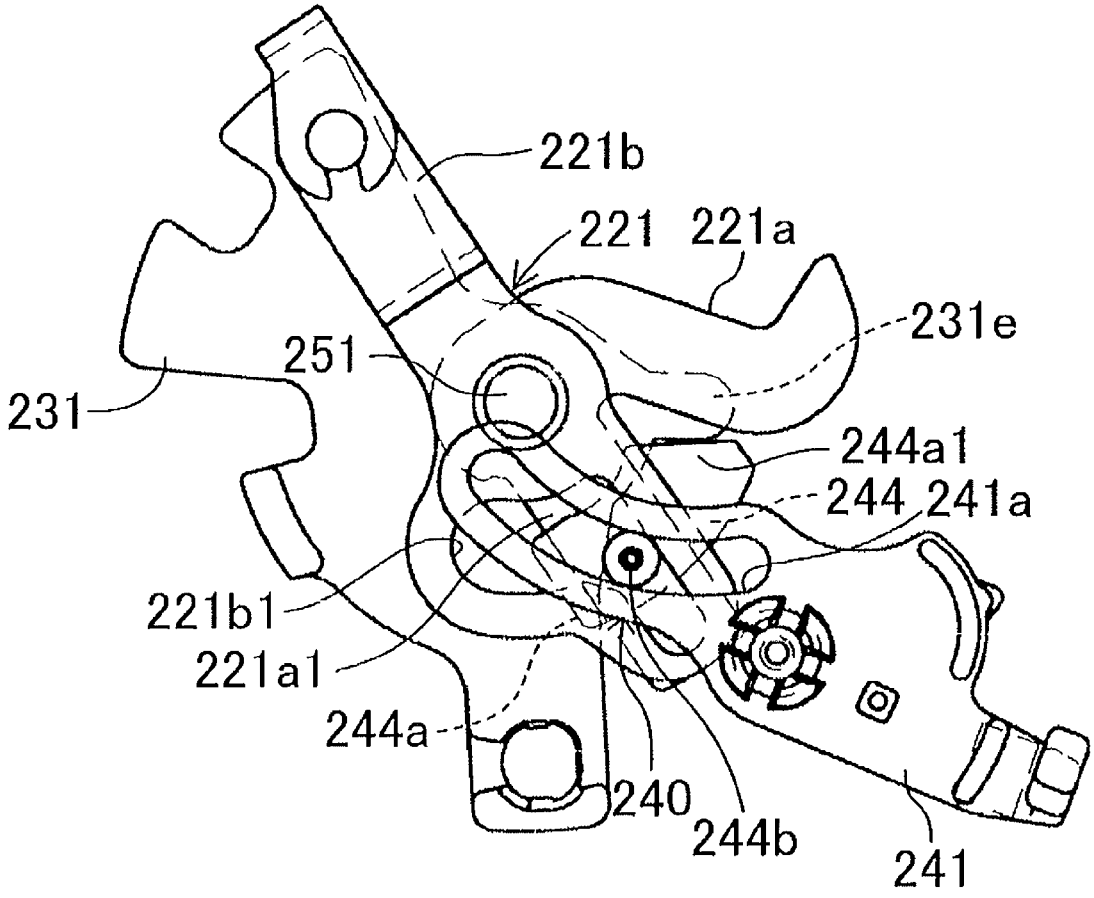
FIG. 18 is an explanatory view for illustrating an actuation at the time when a child safety protector lever illustrated in FIG. 17 is moved to the set position and the active lever is moved to the locked position.

In the embodiment illustrated in FIGS. 16 to 18, the present invention is applied to a configuration as disclosed in, for example, JP 2006-233456 A, and a child safety lock mechanism 240 built into the inside open lever 221 includes a child safety protector lever 241 and further includes an intermediate member 244. The intermediate member 244 is an engagement member including a slide bush 244*a* which is assembled to a support portion 221*a*1 of the first lever 221*a* so as to be movable along a radial direction of the support shaft 251, and an engagement pin 244*b* which projects from the slide bush 244*a* toward the second lever 221*b* and passes through and engages with an odd-shape elongated hole 221*b*1 formed in the second lever 221*b* and an arc elongated hole 241*a* formed in the child safety protector lever 241.

By the way, in the embodiment illustrated in FIGS. 16 to 18, an engagement leg portion 231*e* is set on an active lever 231 having a lock/unlock function equivalent to that of the active lever 31 of the above-mentioned embodiment (embodiment illustrated in FIGS. 1 to 12), and a pushing portion 244*a*1 engageable with the engagement leg portion 231*e* is set on the slide bush 244*a* of the intermediate member 244. When the intermediate member 244 is situated at the unset position (position of FIGS. 16 and 17), the inside door handle (204) is operated to open the door, and the child safety protector lever 241 moves the intermediate member 244 to the set position (position of FIG. 18), the pushing portion 244*a*1 of the intermediate member 244 is set to engage with the engagement leg portion 231*e* of the active lever 231 so that the active lever 231 is movable from the unlocked position (position of FIGS. 16 and 17) to the locked position (position of FIG. 18).

Therefore, also in the embodiment illustrated in FIGS. 16 to 18, in a case of emergency (for example, in a case where the electric motor is not actuated), under the opened state of the door (201), a manual operation of operating the inside door handle (204) to open the door and a manual operation of operating the child safety protector lever 241 from the unset position (position of FIGS. 16 and 17) to the set position (position of FIG. 18) are sequentially performed so that the active lever 231 situated at the unlocked position can be moved to the locked position. Thus, when the inside door handle (204) is then returned to the return position and the door (201) is closed, the locked and set state is obtained in the door lock device, and the locked state of the door (201) (door-locked state in which the door cannot be opened even when the inside door handle or the outside door handle is operated to open the door) is obtained.

In the embodiment illustrated in FIGS. 1 to 12 and the embodiment illustrated in FIGS. 13 to 15 of the above-mentioned embodiments, the following configuration is employed. That is, the intermediate member 44 includes the pushing portion (rectangular bush 44*a* of the embodiment illustrated in FIGS. 1 to 12) engageable with the engagement leg portion 31*e* of the active lever 31, and is assembled to the first lever 21*a* or 121*a* so as to be rotatable integrally with the first lever 21*a* or 121*a*. Further, the second lever 21*b* includes the engagement portion 21*b*2 engageable with the pushing portion (rectangular bush 44*a*) of the intermediate member 44 held in the unset position. Therefore, under the unset state, the engagement portion 21*b*2 of the second lever 21*b* and the pushing portion of the intermediate member 44 engage with each other so that the pushing force transfer from the inside open lever 21 to the open link 23 is enabled. Note that, the pushing force transfer from the inside open lever 21 to the open link 23 under the unset state is performed in such a manner that the pushing force is transferred from the engagement portion 21*b*2 of the second lever 21*b* of the inside open lever 21 to the first lever 21*a* or 121*a* of the inside open lever 21 via the pushing portion of the intermediate member 44, and the pushing force is further transferred from the pushing portion 21*a*2 or 121*a*2 of the first lever 21*a* or 121*a* to the open link 23 via the outside open lever 22.

In contrast, in the embodiment illustrated in FIGS. 16 to 18, the following configuration is employed. That is, the intermediate member 244 includes the pushing portion 244*a*1 engageable with the engagement leg portion 231*e* of the active lever 231, and further includes the engagement pin 244*b* which passes through and engages with the odd-shape elongated hole 221*b*1 of the second lever 221*b* and the arc elongated hole 241*a* of the child safety protector lever 241. Therefore, under the unset state, the first lever 221*a* and the second lever 221*b* of the inside open lever 121 are integrated through an intermediation of the engagement pin 244*b* so that the pushing force transfer from the inside open lever 121 to the open link (23) is enabled. Thus, in the above-mentioned embodiment illustrated in FIGS. 1 to 12 and the above-mentioned embodiment illustrated in FIGS. 13 to 15, it is unnecessary to employ the component corresponding to the engagement pin 244*b* of the intermediate member 244 of the above-mentioned embodiment illustrated in FIGS. 16 to 18. Accordingly, the intermediate member (44) can be constructed more simply as compared to the above-mentioned embodiment illustrated in FIGS. 16 to 18.

The invention claimed is:

1. A vehicle door lock device, comprising:

a latch mechanism capable of maintaining a door of a vehicle in a closed state relative to a body, and adapted to be assembled to the door together with a housing;

an inside open lever assembly assembled to the housing, and adapted to be rotationally driven from an initial position to an actuation position along with a door opening operation of an inside door handle which is provided on an inner side of the door;

an outside open lever assembled to the housing, and adapted to be rotationally driven from an initial position to an actuation position along with a door opening operation of an outside door handle which is provided on an outer side of the door;

an open link assembled tiltably to a coupling portion of the outside open lever, which is shifted along with rotation of the outside open lever, the open link comprising a link portion engageable with an engagement arm portion of a lift lever of the latch mechanism, the open link being pushed from an initial position toward the lift lever when the inside open lever assembly or the outside open lever is rotationally driven from the initial position to the actuation position;

an active lever assembled to the housing, the active lever being switched to a locked position through a lock actuation of an electric actuator to bring the open link into a locked state of being unlinkable to the lift lever, and switched to an unlocked position through an unlock actuation of the electric actuator to bring the open link into an unlocked state of being linkable to the lift lever; and a child safety lock mechanism built into the inside open lever assembly, the child safety lock mechanism being configured to enable pushing force transfer from the inside open lever assembly to the open link in an unset state, and to disable the pushing force transfer in a set state, wherein the inside open lever assembly having the child safety lock mechanism comprises:

a first lever assembled to the housing, and linked to the latch mechanism;

a second lever assembled to the housing, and operated in association with the inside door handle;

an intermediate member interposed between the first lever and the second lever, the intermediate member being retainable at an unset position or a set position; and a child safety protector lever assembled to the housing, the child safety protector lever allowing the intermediate member to move to the unset position or the set position through a manual operation performed from the inner side of the door, wherein the active lever comprises an engagement portion set thereon, and the intermediate member comprises a pushing portion set thereon, and wherein, under a condition where the door is in an opened state and the electric actuator is inoperable, the active lever is situated at the unlocked position, and the intermediate member is situated at the unset position, when a manual operation of the door opening operation of the inside door handle and a manual operation of operating the child safety protector lever to move the intermediate member from the unset position to the set position are sequentially performed, the pushing portion of the intermediate member is engaged with the engagement portion of the active lever so that the active lever moves from the unlocked position to the locked position.

2. A vehicle door lock device according to claim 1, wherein the intermediate member is assembled to the first lever so as to be rotatable integrally with the first lever, wherein the second lever comprises an engagement portion engageable with the pushing portion of the intermediate member held in the unset position, and wherein, under the unset state, the engagement portion of the second lever and the pushing portion of the intermediate member engage with each other so that the pushing force transfer from the inside open lever assembly to the open link is enabled.

3. A vehicle door lock device according to claim 1, wherein the first lever and the second lever are assembled rotatably to the housing through an intermediation of different support shafts.

4. A vehicle door lock device according to claim 1, wherein the first lever and the second lever are arranged coaxially with each other, and are assembled rotatably to the housing through an intermediation of a single support shaft.

5. A vehicle door lock device according to claim 1, wherein, when the manual operation of the door opening operation of the inside door handle, the manual operation of operating the child safety protector lever to move the intermediate member from the unset position to the set position, and a manual operation of operating the door from the opened state to the closed state are sequentially performed under the condition where the door is in the opened state, the door is brought into a locked state in which the active lever is kept to be at the locked position and the door cannot be opened even when the outside door handle is operated to open the door.

* * * * *